United States Patent [19]

Fukuoka

[11] 4,364,186

[45] Dec. 21, 1982

[54] VENTILATED FOOTWEAR

[75] Inventor: Sadao Fukuoka, Tokushima, Japan

[73] Assignee: Fukuoka Kagaku Kogyo Kabushiki Kaisha, Tokushima, Japan

[21] Appl. No.: 229,643

[22] Filed: Jan. 29, 1981

[30] Foreign Application Priority Data

Jun. 19, 1980 [JP] Japan ..... 55-84833[U]
Jun. 19, 1980 [JP] Japan ..... 55-84834[U]

[51] Int. Cl.[3] ..... A43B 7/06; A43B 13/20
[52] U.S. Cl. ..... 36/3 B; 36/29
[58] Field of Search ..... 36/3 R, 3 A, 3 B, 28, 36/29

[56] References Cited

U.S. PATENT DOCUMENTS

| | | | |
|---|---|---|---|
| 3,005,271 | 10/1961 | Brahm | 36/3 B |
| 3,050,875 | 8/1962 | Robbins | 36/3 B |
| 3,791,051 | 2/1974 | Kamimura | 36/3 B |
| 4,078,321 | 3/1978 | Famolare | 36/3 B |

*Primary Examiner*—Patrick D. Lawson
*Attorney, Agent, or Firm*—Edward F. Levy

[57] ABSTRACT

A ventilated article of footwear, such as a shoe, is provided with an outer sole of deformable material having a raised peripheral portion of enlarged thickness surrounding the entire periphery thereof. An inner sole of non-deformable material is mounted above the outer sole in normally spaced relation therefrom to define an air chamber between the soles. The inner sole is perforated with a plurality of apertures providing communication between the air chamber and the interior of the shoe. A compressible supporting material is located in the air chamber between the inner and outer soles and normally biases the deformable outer sole away from the inner sole to provide a relatively deep air chamber. When the wearer of the shoe applies his weight upon the outer sole, the latter deforms upwardly compressing the compressible supporting material and reducing the depth of the air chamber. As the volume of the air chamber decreases, the air therewithin is compressed and is forced through the apertures in the inner sole to the interior of the shoe to provide air circulation. When the wearer's weight is relieved, the deformable outer sole returns to its original position under the biasing action of the supporting material, in cooperation with the raised peripheral portion of the outer sole, to return the air chamber to its original depth and cause a return flow of outside air through the interior of the shoe and into the air chamber.

7 Claims, 21 Drawing Figures

VENTILATED FOOTWEAR

BACKGROUND OF THE INVENTION

This invention relates to a ventilating article of footwear such as a shoe which is capable of circulating air for ventilation, and more particularly to an article of footwear having an outer sole which is constructed to cause air circulation.

The U.S. Pat. No. 3,533,171 discloses an article of footwear in which protrusions project outwardly from the outer sole and are arranged to send compressed air forcibly into the shoe when the protrusions are depressed and deformed.

However, by this specific construction, it is not possible to provide a shoe which affords the necessary stability, due to the fact that this conventional type of ventilated shoe comprises an outer sole having protrusions which deform irregularly. Further, such protrusions impart to the shoe an unusual appearance which tends to give the wearer a sense of non-conformity, and in addition, the protrusions appear as defects which detract from the image of a high grade of shoe.

Furthermore, since air circulation is caused only by deformation of the individual protrusions, it is very difficult to achieve mass air circulation. If the shoe is designed to cause mass air circulation by enlargment of the protrusions, an undesirable loss of stability results. Those disadvantages are inherent in the basic construction of the conventional ventilated shoe.

SUMMARY OF THE INVENTION

The present invention is devised to overcome the disadvantages of the conventional ventilated shoe, and one of the main objects of the invention is to provide a ventilated shoe in which substantially the total area of its outer sole is utilized as an air compressing chamber in order to cause effective and mass air circulation.

Another object of the invention is to provide a ventilated shoe comprising an outer sole which is flexible and resilient so that it deforms entirely and uniformly under pressure of walking, and does not deform only partially.

A further object of the invention is the provision of a ventilated shoe of the character described which presents the outward appearance and configuration of a normal shoe even though it is designed to perform specific ventilating and air circulating functions.

In accordance with the invention, there is provided a ventilated article of footwear comprising an outer sole made of deformable material and having a raised peripheral portion entirely surrounding the body thereof and of greater thickness than said body, an inner sole mounted above said outer sole and forming an air chamber therebetween, with said raised peripheral portion bordering and enclosing said air chamber, and supporting means of deformable material located within said air chamber and being adapted to bias said outer sole away from said inner sole and thereby provide an air chamber of substantial depth. When the weight of the wearer is applied to the outer sole, the latter deforms upwardly relative to the inner sole and the deformable supporting means compresses to reduce the depth of the air chamber and compress the air therein. Aperture means are also provided to direct the compressed air through the interior of the shoe to provide ventilation thereof.

Other features and advantages of the present invention will become apparent from the following detailed description of the preferred embodiments of the invention, when taken in connection with the accompanying drawings.

DESCRIPTION OF THE PREFERRED EMBODIMENTS

The present invention will now be described in detail by way of preferred embodiments thereof with reference to the accompanying drawings.

Figure 1:
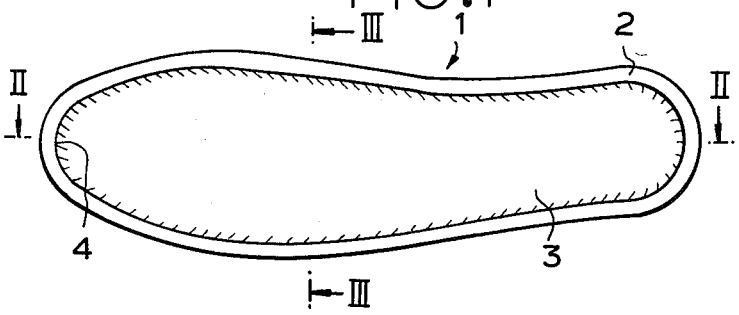
FIG. 1 is a top plan view of the outer sole of a ventilated shoe made in accordance with the present invention.
Figure 2:
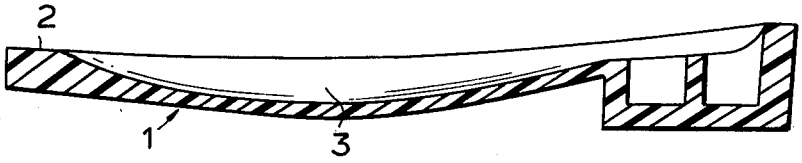
FIG. 2 is a central longitudinal section of the shoe outer sole taken along the line 2—2 of FIG. 1.
Figure 3:
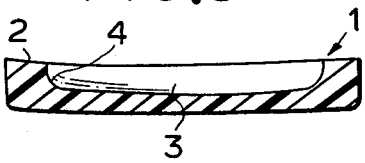
FIG. 3 is a transverse sectional view taken along the line 3—3 of FIG. 1.

FIGS. 1 to 3 illustrate the desired form of the outer sole 1 of the ventilated shoe of the present invention. The outer sole 1 is made of a deformable material such as polyvinyl chloride, synthetic rubber or polyurethane resin, and is formed with a raised or upstanding portion 2 extending around its entire periphery. The upstanding portion 2 surrounds a concave area 3 of the outer sole 1, and these two portions are joined by a curved slope 4.

As shown in FIGS. 2 and 3, the raised portion 2 is designed to have an appreciable thickness and a flat top surface of substantial width, so that it serves to reinforce the strength of the outer sole 1, and in addition is utilized for the bonding of a shoe upper 5 (FIG. 4) which constitutes the lasted inner portion of the shoe.

Figure 4:
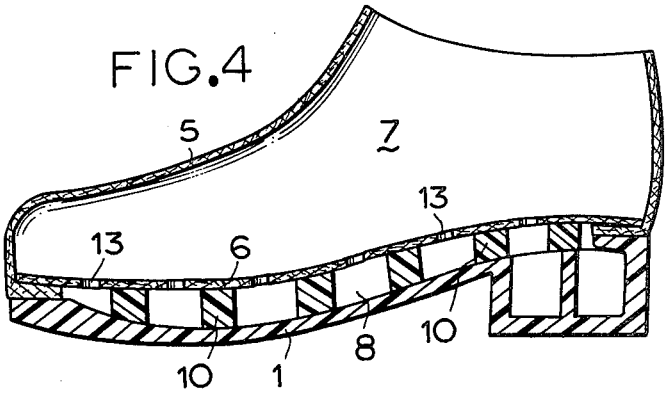
FIG. 4 is a vertical sectional view of a ventilated shoe showing one embodiment of ventilating structure of the present invention.
Figure 5:
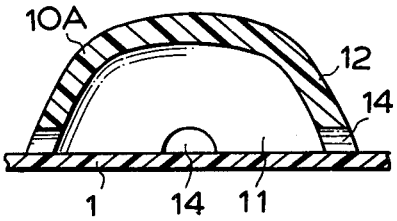
FIG. 5A is an enlarged sectional view illustrating as one preferred embodiment of the sole supporting and separating means, one form of insertion material which may be utilized in this invention.
FIG. 5B is a top plan view of the shoe outer sole showing the insertion material of FIG. 5A mounted on the upper surface thereof.

FIG. 4 shows a ventilated shoe 7 in which the outer sole of FIGS. 1 to 3 is utilized. Mounted above the outer sole 1 and spaced therefrom is an inner sole 6 which is made of a relatively rigid and non-deformable plate material such as hard paper board. An air chamber 8 is formed in the gap between the inner sole 6 and the concave area 3 of the outer sole 1, which air chamber 8 is bordered and enclosed by the raised peripheral portion 2 of the outer sole. Within the air chamber 10 is contained a compressible insertion material which is mounted along the inner surface of the outer sole 1. The insertion material 10 is resilient and it biases the deformable outer sole 1 away from the non-deformable inner sole 6, thereby cooperating with the raised portion 2 of the outer sole to position the soles normally spaced from each other, in the manner shown in FIG. 4, to provide an enlarged air chamber 8 in the gap between the soles.

The inner sole 6 is perforated at spaced intervals to provide ventilating holes 13 through which the air chamber 8 communicates with the interior of the shoe 7.

Accordingly, when the wearer depresses his shoe upon the ground, the weight of the wearer is applied through the insertion material 10 to the outer sole 1 which is deformed upwardly by its engagement with the ground. This upward deformation of the outer sole, relative to the non-deformable inner sole 6, causes the resilient insertion material 10 to compress and deform, and the air chamber 8 is thereby reduced in depth. The air contained in the air chamber 8 is compressed and forced out through the ventilating holes 13 in the inner sole 6, entering the interior of the shoe 7. Air circulation throughout the shoe upper is accomplished through spaces between the shoe and the foot of the wearer.

Reference is now made to FIGS. 5 through 11 which illustrate various embodiments of insertion materials 10 which may be used in the ventilated shoe of the present invention.

FIG. 5A shows one form of insertion material 10A in the form of a dome-shaped inverted cup which is sized to be interposed between the inner sole 6 and outer sole 1. A preferred manner of installation of the insertion material 10A in the shoe would be to have the open end of the semicircular insertion material 10A facing the outer sole 1, as shown in FIG. 5A. Each individual dome-shaped unit of the insertion material 10A is provided with one or more ventilating apertures 14.

FIG. 5B shows the manner in which a plurality of individual insertion elements 10A are arranged in a spaced pattern over the entire extent of the outer sole 1, within the raised peripheral portion 2 thereof.

When the weight of the wearer is applied to the outer sole 1, each element of the insertion material 10A is depressed so that the air contained therein is forcibly exhausted through its ventilating aperture 14 into the air chamber 8. This compression of the insertion elements results in response to upward and inward deformation of the outer sole, which deformation also reduces the depth of the air chamber 8, and compresses the air therein. Thus air is exhausted from the air chamber 8 into the interior of the shoe 7 through the ventilating holes 13 in the inner sole 6.

When the wearer raises his foot from the ground to release his weight load on the shoe, the outer sole 1 and insertion material 10A return to their original condition owing to their resilient nature, thereby restoring the air chamber 8 to its expanded condition and creating a negative pressure which causes a flow of fresh air to move from the interior of the shoe 7 into the air chamber 8 and into the hollow interior 11 of each of the insertion elements 10A.

Since the elements of the insertion material 10A are of dome shape, the load applied from the inner sole 6 is distributed via the semi-spherical wall 12 over a rather extensive area of the outer sole 1. Thus, the load is not concentrated upon a small point on the outer sole, and resultant excessive wear of the outer sole 1 is prevented.

FIG. 6A shows another embodiment of insertion material 10B which in this instance constitutes a plurality of solid elements of circular cross-section made of a compressible material and constricted at the middle portion as illustrated. The central constriction enables each of the elements 10B to be compressed vertically without horizontal expansion, and thus the volume of air within the air chamber 8 is not affected.

Figure 6:
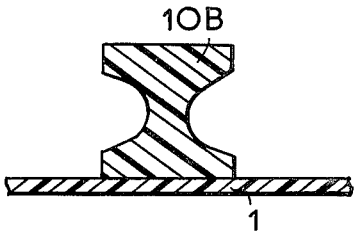
FIG. 6A is an enlarged sectional view illustrating another form of insertion material.
FIG. 6B is a top plan view of the shoe outer sole, illustrating the manner in which the insertion material of FIG. 6A is arranged thereon.
Figure 5:
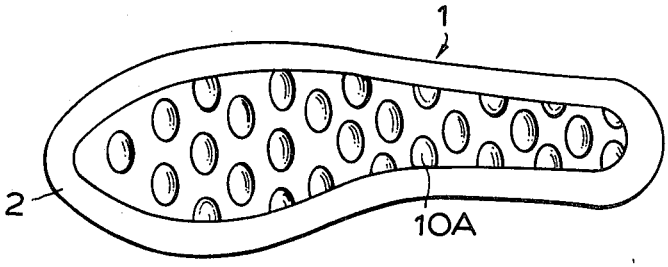
Figure 6:
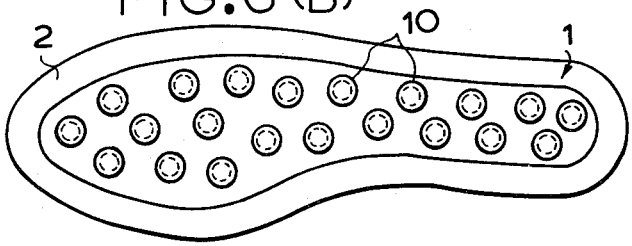
Figure 7:
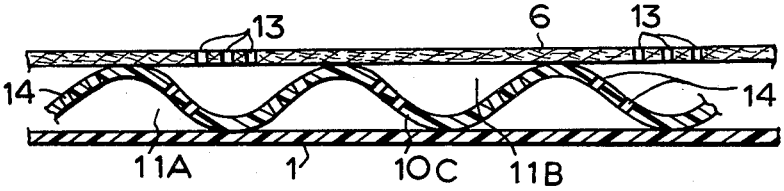
FIG. 7A is an enlarged sectional view illustrating still another embodiment of the insertion material which, in this case, is made in the form of a corrugated membrane.
FIG. 7B is a top plan view of the shoe outer sole with the corrugated membrane insertion material of FIG. 7A mounted on the upper surface thereof.
Figure 7:
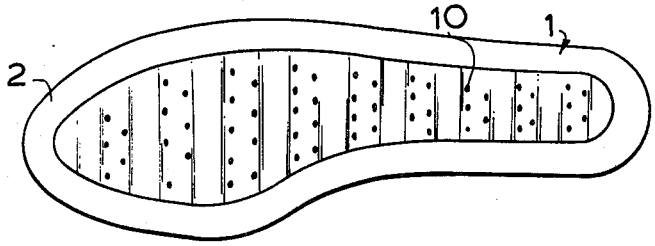
Figure 8:
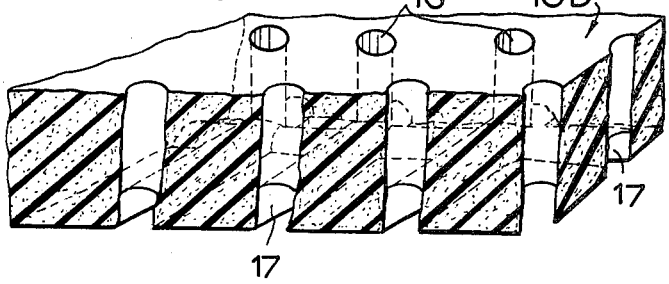
FIG. 8A is an enlarged perspective, cut-away view illustrating a further embodiment of the insertion material of the invention, which in this instance is made of sponge rubber.
FIG. 8B is a top plan view of the shoe outer sole showing the sponge rubber insertion material of FIG. 8A positioned thereon.
Figure 8:
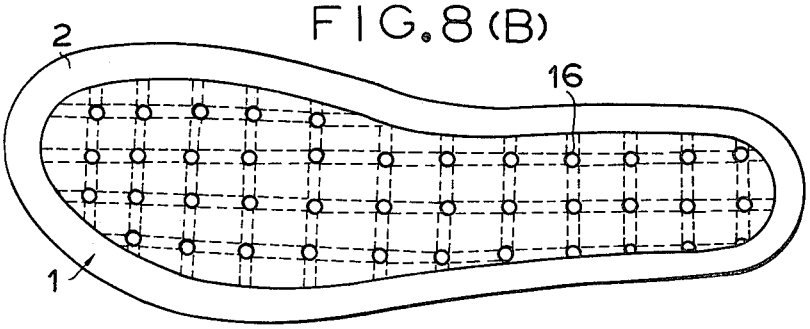
Figure 9:
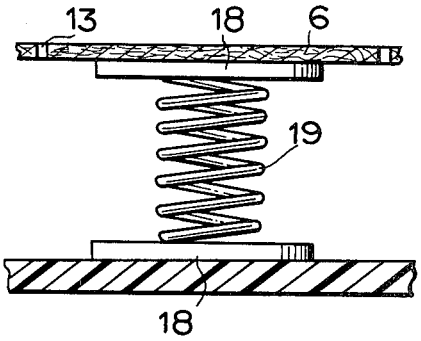
FIG. 9A is an enlarged sectional view illustrating a coil spring as another example of insertion material for the shoe.
FIG. 9B is a top plan view of the shoe outer sole in which the spring insertion material of FIG. 9A is positioned.
Figure 9:
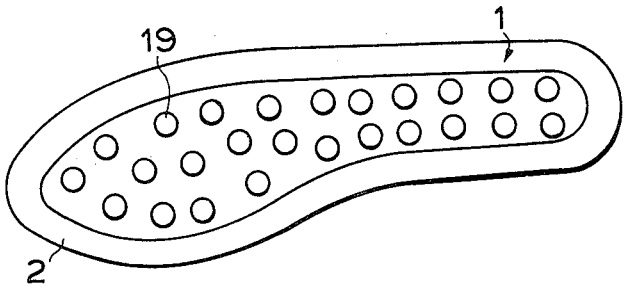

Due to the specific construction of the insertion material 10B, it is possible to provide a large number of elements, each with a high density without unduly filling up the interior volume of air chamber 8. In addition, in mounting the insertion material to the shoe, if too much adhesive is applied to the ends of the insertion material, the excess drops of adhesive are absorbed on the surface of the constricted portion. Thus the process of adhering the inner sole to the outer sole is easily performed. FIG. 6 shows the manner in which the individual insertion material elements 10B are arranged in a spaced pattern upon the outer sole 1.

FIG. 7A illustrates another embodiment of insertion material in the form of a resilient and compressible corrugated membrane 10C which is located between the inner sole 6 and outer sole 1, and which divides the air chamber 8 into inner air chambers 11A and outer air chambers 11B. The corrugated membrane 10C is formed with ventilation holes 14 which provide communication between the inner and outer air chambers 11A and 11B. FIG. 7B shows the manner in which the corrugated membrane 10C is applied to the upper surface of the outer sole 1. The movement and operation of the corrugated membrane 10C during compression and expansion may be readily understood from the previous description of the embodiment of FIG. 5A.

As another example, the insertion material may be made of resilient material such as sponge rubber or foam plastic composed of contiguous air cells. This embodiment is illustrated in FIG. 8A as a sponge rubber block 10D formed with vertical bores 16 which communicate with each other by means of horizontal connecting slits 17 formed in the lower surface of the sponge rubber member 10D. Because of this specific construction, with all of the vertical bores 16 communicating with each other via the slits 17, when the sponge rubber member is compressed, compressed air is exhausted through the ventilation holes 13 of the inner sole into the interior of the shoe. FIG. 8B shows the sponge rubber member 10D applied to the concave area of the shoe outer sole 1.

It is also possible to utilize a coil spring 19 as the insertion material, as shown in FIG. 9A. When the coil spring 19 is utilized, circular plates 18 should be mounted on the ends thereof for distributing the load which is applied to the inner sole 6 and outer sole 1. FIG. 9B shows a plurality of coil springs 19, terminating in circular plates, mounted on the outer sole 1.

Figure 10:
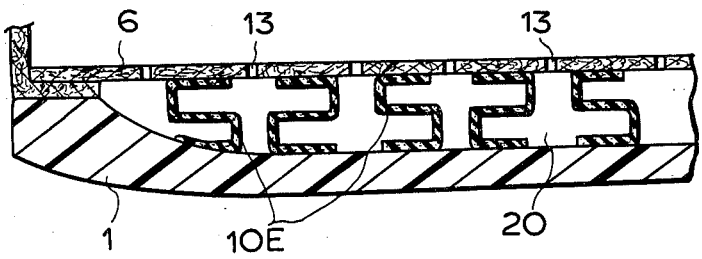
FIGS. 10 and 11 are enlarged sectional views illustrating further embodiments of the insertion material which may be used in the ventilated shoe.
Figure 11:
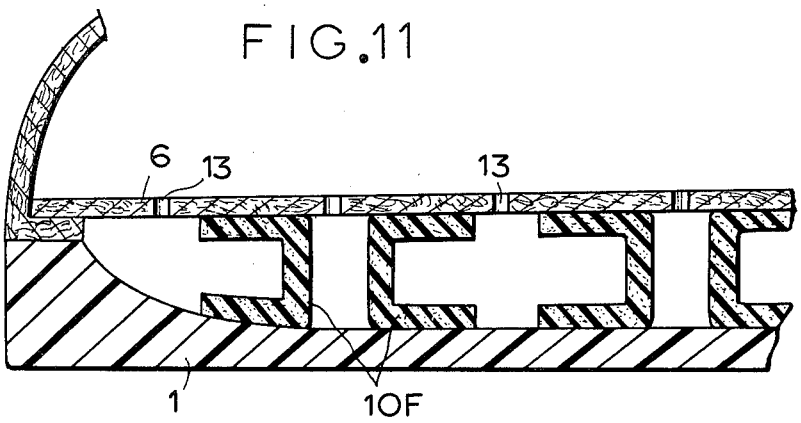

Similar spring members in the form of S-shaped members 10E may serve as the insertion material, as shown in FIG. 10. In this embodiment, when the members 10E are mounted between the inner and outer soles, as shown, air current channels 20 are defined between adjacent S-shaped members 10E which alternately face in opposite directions, which air channels contribute to a high rate of air flow. As an alternative, spring-type insertion membranes 10F of U-shape may be provided and utilized in a like manner, as illustrated in FIG. 11.

In the embodiment of the outer sole 1 shown in FIGS. 1 to 3 and previously described, the raised peripheral portion 2 is made solid and of a substantial thickness so that, in surrounding the concave area 3, it provides sufficient body strength to the outer sole to enable the concave area 3 to deform inwardly under the force of the wearer's weight, and it also permits the concave area to bow outwardly when the weight is removed, so that its original concave condition is restored. The flat top surface of the thick raised peripheral portion 2 provides an advantageous wide area for the adhesive attachment of the shoe upper during the lasting operation, which is a convenience in the manufacture of the shoe.

Figure 12:
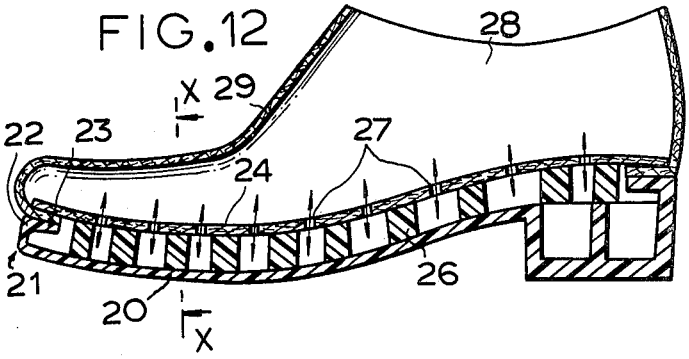
FIG. 12 is a longitudinal section through a ventilated shoe having a modified embodiment of outer sole made in accordance with the invention.
Figure 13:
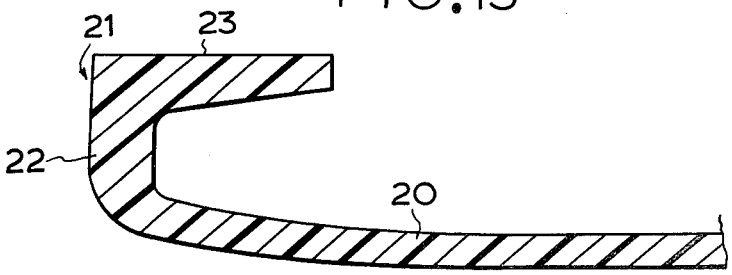
FIG. 13 is an enlarged sectional view showing in detail the forward portion of the outer sole of FIG. 12 with its extended flange portion.
Figure 14:
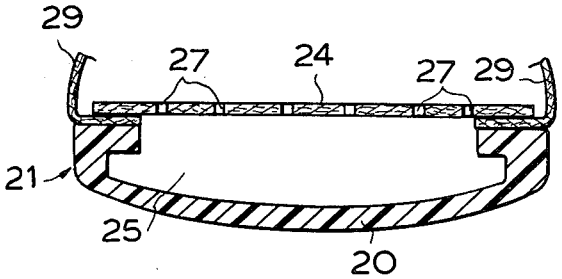
FIG. 14 is a transverse sectional view taken along the line X—X of FIG. 12.

FIGS. 12 to 15 illustrate another embodiment of outer sole 20 which may be used in the ventilated shoe of the invention. In this embodiment, the outer sole 20 is provided with an upstanding peripheral member 21 of angular shape, providing a overhang. The overhang member 21 has an upstanding flange 22 terminating in a horizontal ledge or collar 23. The upstanding flange 22 encloses an air chamber 25 between the outer sole 20 and inner sole 24. Reference numeral 26 indicates an insertion material made of resilient, deformable and pneumatic material such as sponge rubber, which, when compressed will expand the volume of air within the air chamber 25. A sufficient number of ventilating holes 24 are provided in the inner sole 24 to provide communication between the air chamber 25 and the interior of the shoe 28. The upper is lasted beneath the inner sole 24, as shown in FIGS. 12 and 14, and cemented to the upper surface of ledge or collar 23. As shown in the sectional view of FIG. 14, the overhang member 21 extends around the entire periphery of the outer sole 20.

Figure 15:
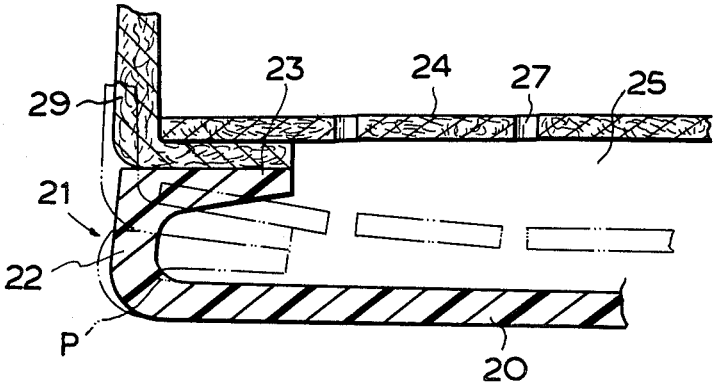
FIG. 15 is an enlarged sectional view showing a portion of the sole of FIG. 14 and illustrating movement of the parts thereof under compression.

When the shoe of FIG. 12 is worn, and the weight of the wearer is applied to the outer sole 20, the insertion material 26 is depressed against the resistance of the ground, and the outer sole deforms around a yielding point P in a direction to compress the air chamber 25, as shown in broken line in FIG. 15. Accordingly, compressed air is forced through the ventilating holes 27 into the shoe interior 28, and fresh air circulation is achieved through the gap between the wearer's ankle and the shoe upper.

Figure 16:
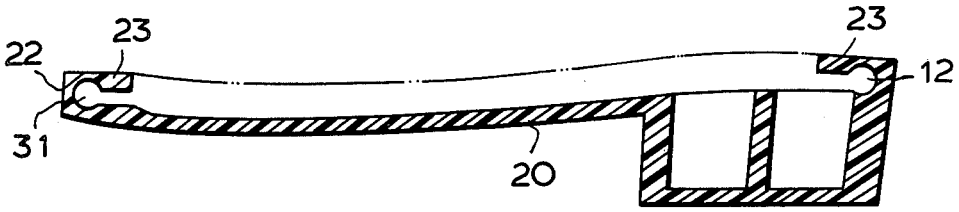
FIG. 16 is a longitudinal sectional view illustrating a further embodiment of outer sole made in accordance with the invention.

It is desirable that the outer sole 20 be made of a deformable material such as polyvinyl chloride, synthetic rubber or polyurethane resin, and it is further essential that the outer sole be provided with a suitable stiffness and the ability to restore its shape after deformation so as to provide stability in the wearing of the shoe. The desired mass of air flow is achieved by a sudden compression of the air in air chamber 25. In view of these requirements, a groove 31, as shown in FIG. 16 may be provided on the neck portion of the peripheral overhang 21. With such construction, when the wearer's weight is applied to the outer sole 20, it causes a sharp deformation centered around the groove 31, and the desired mass air flow is achieved by such deformation. The insertion material 26 used with these outer sole embodiments may be any of the examples shown in FIGS. 5 to 11.

While the invention has been particularly shown and described with reference to preferred embodiments thereof, it will be understood by those skilled in the art that various changes in form and details may be made in such embodiments without departing from the spirit and scope of the invention.

What I claim is:

1. A ventilated article of footwear comprising an outer sole of deformable material having a concavity of appreciable depth formed in its upper surface and extending over substantially the entire area of said outer sole, said outer sole also having a upstanding peripheral portion of selected thickness entirely surrounding the body thereof, an inner sole mounted above said outer sole and overlying said concavity to form an air chamber of appreciable depth between said soles, with said upstanding peripheral portion bordering and enclosing said air chamber, said inner sole having a plurality of ventilating apertures formed therein and providing communication between said air chamber and the interior of said article of footwear, and supporting means of deformable material located within said air chamber in abutment with said inner sole and outer sole and being adapted to compress in response to deformation of the outer sole when the weight of the wearer is applied to the latter, whereby the upstanding peripheral portion of said deformable outer sole provides a force factor for upward deformation of said outer sole toward said inner sole under applied weight of the wearer, and for restitution of said outer sole to its non-deformed condition when the wearer's weight is released therefrom, the upward deformation of said outer sole reducing the depth of said air chamber sufficiently to compress the air therein, thereby discharging said compressed air through said ventilating apertures into the interior of said article of footwear.

2. A ventilated article of footwear as claimed in claim 1 wherein said outer sole increases in thickness as it approaches said raised peripheral portion for augmenting the force of restitution of said outer sole.

3. A ventilated article of footwear as claimed in claim 1, wherein said raised peripheral portion extends upwardly at a sharp angle from the peripheral edge of said outer sole.

4. A ventilated article of footwear according to claim 3, in which said raised peripheral portion is formed with an integral flange extending substantially horizontally from the upper end thereof.

5. A ventilated article of footwear according to claim 4 in which said raised peripheral portion is formed with a groove at its juncture with said horizontally-extending flange.

6. A ventilated article of footwear according to claim 1 in which said raised peripheral portion of the outer sole has a flat top surface underlying and supporting said inner sole in spaced relation to said outer sole, said inner sole being made of a substantially non-deformable material.

7. A ventilated article of footwear as claimed in claim 6, wherein said supporting means is resilient and biases said deformable outer sole away from said substantially non-deformable inner sole.

* * * * *